US005589448A

United States Patent [19]

Koerner et al.

[11] Patent Number: 5,589,448

[45] Date of Patent: Dec. 31, 1996

[54] HIGH WATER LIQUID ENZYME PREWASH COMPOSITION

[75] Inventors: Michael Koerner, Pleasanton; David L. Deleeuw, San Ramon, both of Calif.

[73] Assignee: The Clorox Company, Oakland, Calif.

[21] Appl. No.: 474,353

[22] Filed: Jun. 7, 1995

Related U.S. Application Data

[63] Continuation of Ser. No. 18,621, Feb. 17, 1993, abandoned.

[51] Int. Cl.[6] ..... C11D 3/386

[52] U.S. Cl. ..... 510/284; 510/417; 510/418; 510/392; 510/530

[58] Field of Search ..... 252/174.21, 174, 252/173, 174.22, DIG. 1, DIG. 12, 174.12

[56] References Cited

U.S. PATENT DOCUMENTS

| | | | |
|---|---|---|---|
| 3,741,902 | 6/1973 | Barrett, Jr. et al. | 252/90 |
| 3,746,649 | 7/1973 | Barrett, Jr. et al. | 252/170 |
| 3,761,420 | 9/1973 | Bogardus | 252/171 |
| 3,784,476 | 1/1974 | van Kampen et al. | 252/109 |
| 3,812,041 | 5/1974 | Inamorato | 252/89 |
| 3,819,528 | 6/1974 | Berry | 252/153 |
| 3,860,536 | 1/1975 | Landwerlen et al. | 252/551 |
| 3,869,399 | 3/1975 | Collins | 252/118 |
| 3,870,647 | 3/1975 | Travers | 252/118 |
| 3,953,351 | 4/1976 | Keller | 252/132 |
| 4,021,377 | 5/1977 | Borchert et al. | 252/546 |
| 4,079,078 | 3/1978 | Collins | 252/545 |
| 4,105,431 | 8/1978 | Lewis et al. | 71/67 |
| 4,169,817 | 10/1979 | Weber | 252/545 |
| 4,178,262 | 12/1979 | Compton et al. | 252/162 |
| 4,199,482 | 4/1980 | Renaud et al. | 252/559 |
| 4,201,686 | 5/1980 | Augustijn | 252/174.22 |
| 4,243,546 | 1/1981 | Shaer | 252/174.12 |
| 4,252,694 | 2/1981 | Lewis et al. | 252/545 |
| 4,268,262 | 5/1981 | Bechstedt | 8/137 |
| 4,285,841 | 8/1981 | Barrat et al. | 252/559 |
| 4,287,082 | 9/1981 | Tolfo et al. | 252/174.12 |
| 4,295,845 | 10/1981 | Sepulveda et al. | 8/139.1 |
| 4,305,837 | 12/1981 | Kaminsky et al. | 252/174.12 |
| 4,318,818 | 3/1982 | Letton | 252/174.12 |
| 4,338,212 | 7/1982 | Wegener et al. | 252/174.22 |
| 4,362,638 | 12/1982 | Caskey et al. | 252/90 |
| 4,404,115 | 9/1983 | Tai | 252/135 |
| 4,438,009 | 3/1984 | Brusky et al. | 252/90 |
| 4,457,857 | 7/1984 | Sepulveda et al. | 252/174.21 |
| 4,515,705 | 5/1985 | Moeddel | 252/174.12 |
| 4,530,780 | 7/1985 | van de Pas et al. | 252/528 |
| 4,537,707 | 8/1985 | Severson, Jr. | 252/545 |
| 4,595,527 | 6/1986 | Gipp | 252/546 |

(List continued on next page.)

FOREIGN PATENT DOCUMENTS

| | | | |
|---|---|---|---|
| 0414549 | 2/1991 | European Pat. Off. . | |
| 497337 | 8/1992 | European Pat. Off. | C11D 3/39 |
| 9105845 | 5/1991 | WIPO . | |

OTHER PUBLICATIONS

J. Gorrell et al., "Introduction to KATHON® GC and Isothiazolone Biocides".

*Primary Examiner*—Douglas J. McGinty
*Assistant Examiner*—Kery Fries
*Attorney, Agent, or Firm*—Joel J. Hayashida; Michael J. Mazza; Harry A. Pacini

[57] ABSTRACT

The invention provides a high water liquid enzyme prewash composition essentially free of hydrotropes, solvents and dispersants other than nonionic surfactants, and combines: a) effective amounts of a hydrolase enzyme stabilized with a soluble alkaline earth salt; b) a more hydrophilic, first nonionic surfactant having an HLB of greater than about 11; c) a more hydrophobic, second nonionic surfactant having an HLB of less than or equal to about 11; d) at least 80% or greater water; wherein the difference in HLB between said first and second nonionic surfactants is at least about 2, and said nonionic surfactants interact with said water to form an opalescent, structured liquid, said structured liquid both suspending said hydrolase and protecting said hydrolase against deactivation with said water. Suitable adjuncts, such as mildewstats/bacteristats, fragrances and dyes can be included.

15 Claims, 3 Drawing Sheets

U.S. PATENT DOCUMENTS

| | | | |
|---|---|---|---|
| 4,608,189 | 8/1986 | Koch et al. | 252/174.22 |
| 4,648,987 | 3/1987 | Smith et al. | 252/559 |
| 4,711,739 | 12/1987 | Kandath | 252/139 |
| 4,738,791 | 4/1988 | Ertle | 252/118 |
| 4,738,792 | 4/1988 | Ertle | 252/118 |
| 4,749,516 | 6/1988 | Brusky | 252/546 |
| 4,767,562 | 8/1988 | Fry | 252/174.12 |
| 4,793,943 | 12/1988 | Haslop et al. | 252/135 |
| 4,801,544 | 1/1989 | Munk | 435/188 |
| 4,822,511 | 4/1989 | Law | 252/106 |
| 4,834,900 | 5/1989 | Soldanski et al. | 252/88 |
| 4,861,516 | 8/1989 | Kurzendorfer et al. | 252/531 |
| 4,900,475 | 2/1990 | Ramachandran et al. | 252/532 |
| 4,909,962 | 3/1990 | Clark | 252/547 |
| 4,911,857 | 3/1990 | Machin et al. | 252/98 |
| 4,959,179 | 9/1990 | Aronson et al. | 252/135 |
| 5,021,195 | 6/1991 | Machin et al. | 252/545 |
| 5,035,826 | 7/1991 | Durbut et al. | 252/121 |
| 5,071,586 | 12/1991 | Kaiserman | 252/174.12 |
| 5,154,580 | 10/1992 | Deguchi et al. | 252/174.17 |
| 5,186,856 | 2/1993 | Holland | 252/143 |
| 5,205,957 | 4/1993 | Van DePas | 252/173 |
| 5,269,960 | 12/1993 | Gray et al. | 252/174.12 |

HIGH WATER LIQUID ENZYME PREWASH COMPOSITION

This is a continuation of Ser. No. 08/018,621, filed Feb. 17, 1993, now abandoned.

BACKGROUND OF THE INVENTION

1. Field of the Invention

The invention relates to a high water liquid enzyme prewash composition essentially free of hydrotropes, solvents and dispersants other than nonionic surfactants, in which enzymes are stably suspended in a structured liquid matrix and are further protected against deactivation by free water.

2. Brief Statement of the Related Art

Many liquid detergent and prewash (or prespotter) compositions have been formulated to meet the need for pretreatment of particularly problematic fabric stains, whether oily, particulate or enzyme-sensitive. Each of these products suffers from various drawbacks. Gelled or semi-solid prewash sticks require direct, mechanical application to the fabric and may not be desirable for all purposes. Liquid products are convenient to use but, typically, are limited in purpose since many are formulated primarily to attack oily stains. For example, Barrett, Jr., U.S. Pat. No. 3,741,902, discloses a laundry prespotter in which large amounts of organic solvent and a nonionic surfactant are combined to produce a nonaqueous composition. However, high amounts of organic solvents in products are disfavored because of current regulatory schemes. Bogardus, U.S. Pat. No. 3,761,420, discloses a stabilized enzyme stain remover in which enzymes are protected from deactivation in aqueous matrix by large amounts of glycerol, a solvent. To similar effect are Barrett, Jr., U.S. Pat. No. 3,746,649 (variety of solvents), Weber, U.S. Pat. No. 4,169,817 (propylene glycol), Landwerlen et al., U.S. Pat. No. 3,860,536 (propylene glycol), Fry, U.S. Pat. No. 4,767,562 (propylene glycol) and Kandathil, U.S. Pat. No. 4,711,739 (insoluble polyether polyol and hydrocarbon solvent).

However, none of the foregoing references teaches, discloses or suggests a high water liquid enzyme prewash composition essentially free of organic solvents, hydrotropes and dispersants other than nonionic surfactants in which the enzyme is stably suspended in a structured liquid matrix caused by interaction of the nonionic surfactants in the highly aqueous medium and in which the enzyme is protected against deactivation by water by said structured liquid matrix.

SUMMARY OF THE INVENTION AND OBJECTS

The invention provides a high water liquid enzyme prewash composition essentially free of hydrotropes, solvents and dispersants other than nonionic surfactants, comprising:

a) effective amounts of a hydrolase enzyme stabilized with a soluble alkaline earth salt;

b) a more hydrophilic, first nonionic surfactant having an HLB of greater than about 11;

c) a more hydrophobic, second nonionic surfactant having an HLB of less than or equal to about 11;

d) at least 80% or greater water;

wherein the difference in HLB between said first and second nonionic surfactants is at least about 2, and said nonionic surfactants interact with said water to form an opalescent, structured liquid, said structured liquid both suspending said hydrolase and protecting said hydrolase against deactivation with said water.

It is therefore an object of this invention to provide a high water liquid enzyme prewash composition without the use of solvents, hydrotropes or other dispersants other than nonionic surfactants.

It is a further object of this invention to provide a high water liquid enzyme prewash composition in which a first and second nonionic surfactant interact with the water to form a structured liquid which both stably suspends and protects the enzyme in the aqueous medium.

It is a still further object of this invention to provide a high water liquid enzyme prewash composition which stabilizes enzymes against deactivation from water without the need for additional solvent stabilizers such as propylene glycol, apart from minor amounts associated with the enzyme or in the surfactant.

It is another object of this invention to provide a high water liquid enzyme prewash composition including a sufficient amount of soluble alkaline earth salt which acts to maintain the enzyme suspended in the structured liquid of the inventive prewash composition.

It is yet another object of this invention to provide a high water liquid enzyme prewash composition with a preservative which does not deactivate the enzyme.

It is still another object of this invention to provide a high water liquid enzyme prewash composition in which a first nonionic surfactant forms a first, continuous phase with the water in the composition and a second nonionic surfactant forms a dispersed, lamellar phase in said first phase.

It is also another object of this invention to provide a high water liquid enzyme prewash composition with a pH between above about 4 and below 8 in order to maximize retention of enzyme activity.

DETAILED DESCRIPTION OF THE INVENTION

Figure 1:
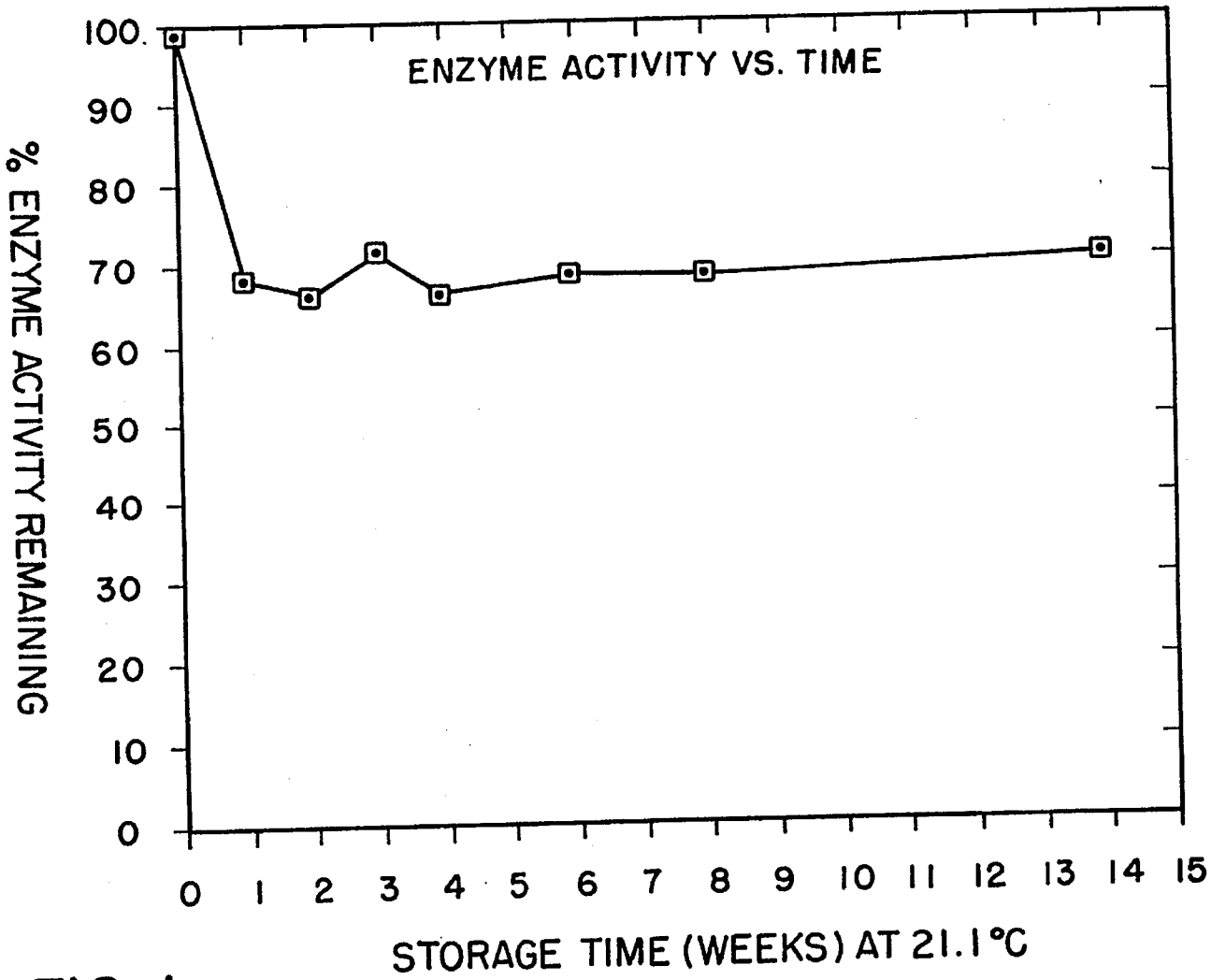
FIG. 1 is a graph plotting % retained enzyme activity versus time in weeks for the inventive high water liquid enzyme prewash composition.

The invention is a high water liquid enzyme prewash composition essentially free of hydrotropes, solvents and dispersants other than nonionic surfactants, comprising:

a) effective amounts of a hydrolase enzyme stabilized with a soluble alkaline earth salt;

b) a more hydrophilic, first nonionic surfactant having an HLB of greater than about 11;

c) a more hydrophobic, second nonionic surfactant having an HLB of less than or equal to about 11;

d) at least 80% or greater water;

wherein the difference in HLB between said first and second nonionic surfactants is at least 2, and said nonionic surfactants interact with said water to form an opalescent, structured liquid, said structured liquid both suspending said hydrolase and protecting said hydrolase against deactivation with said water.

Standard, additional adjuncts in small amounts such as fragrance, dye, mildewstat/bacteristat and the like can be included to provide desirable attributes of such adjuncts.

In the application, effective amounts are generally those amounts listed as the ranges or levels of ingredients in the descriptions which follow here to. Unless otherwise stated, amounts listed in percentage ("%'s") are in weight percent of the composition, unless otherwise noted.

1. Hydrolase Enzymes

The first critical component of the invention is hydrolase enzyme, which is especially desirable herein. In order to maintain optimal activity of these enzymes in the aqueous matrix of the invention, it is preferred that an enzyme stabilizer be present, as discussed below. The enzymes used herein are hydrolytic enzymes, or hydrolases, which act by hydrolyzing a given substrate (stain or soil), converting the substrate to a more soluble or easily removed form.

Proteases are one especially preferred class of enzymes. They are selected from acidic, neutral and alkaline proteases. The terms "acidic," "neutral," and "alkaline, " refer to the pH at which the enzymes' activity are optimal. Examples of neutral proteases include Milezyme® (available from Miles Laboratory) and trypsin, a naturally occurring protease. Alkaline proteases are available from a wide variety of sources, and are typically produced from various microorganisms (e.g., *Bacillis subtilisin*). Typical examples of alkaline proteases include Maxatase® and Maxacal® from International BioSynthetics, Alcalase®, Savinase® and Esperase®, all available from Novo Nordisk A/S. See also Stanislowski et al., U.S. Pat. No. 4,511,490, incorporated herein by reference.

Further suitable enzymes are amylases, which are carbohydrate-hydrolyzing enzymes. It is also preferred to include mixtures of amylases and proteases. Suitable amylases include Rapidase®, from Société Rapidase, Termamyl® from Novo Nordisk A/S, Milezyme® from Miles Laboratory, and Maxamyl® from International BioSynthetics.

Still other suitable enzymes are cellulases, such as those described in Tai, U.S. Pat. No. 4,479,881, Murata et al., U.S. Pat. No. 4,443,355, Barbesgaard et al., U.S. Pat. No. 4,435,307, and Ohya et al., U.S. Pat. No. 3,983,082, incorporated herein by reference.

Yet other potentially suitable enzymes are lipases, such as those described in Silver, U.S. Pat. No. 3,950,277, and Thom et al., U.S. Pat. No. 4,707,291, incorporated herein by reference.

The hydrolytic enzyme should be present in an amount of about 0.0001–10% (based on 100% active enzyme; most commercially vended enzymes are sold as liquids, slurries, prills or solids, in which either a liquid or solid filler/stabilizer is included, e.g., propylene glycol), more preferably about 0.001–5%, and most preferably about 0.01–2% by weight of the detergent. Mixtures of any of the foregoing hydrolases are desirable, especially protease/amylase blends.

The preferred hydrolase enzyme used herein is an alkaline protease. These types of enyzmes are effective at removing many different types of soils, but especially, protein-based stains. Moreover, these enzymes are widely available from a variety of commercial sources.

Enzyme stability in highly aqueous systems has been very problematic. This problem was summed up by Kandathil, U.S. Pat. No. 4,711,739 thusly:

> "Water is known to have a deteriorating effect on the catalytic activity of hydrolytic enzymes. During storage in water in the absence of a substrate capable of being hydrolyzed, the enzymes tend to digest themselves." (Kandathil, Column 4, lines 25–29)

Kandathil's solution to this recognized problem was to use relatively large amounts of both an insoluble polyether polyol and hydrocarbon solvents to stabilize the enzyme. A secondary effect of having so many diverse ingredients in Kandathil's system was to drive down the total amount of water, resulting in a complex, expensive system. By contrast, the invention presents a high water, straightforward liquid prewash composition in which only one deliberately added stabilizer is essentially present, namely, a soluble alkaline earth salt. The soluble alkaline earth salt interacts with the enzyme and the structured liquid phase (a more detailed description of which follows herein) of the invention in order to both stably suspend the enzyme and protect it against deactivation from the high level of water present in the invention. The soluble alkaline earth salts are selected from calcium, magnesium and barium salts, typical of which are formates, acetates, propionates, hydroxides and chlorides. Calcium chloride is especially preferred. The amount of soluble alkaline earth salt should be preferably about 1 part per million ("ppm") to about 10,000 ppm, more preferably about 10 ppm to about 1,000 ppm, and most preferably about 10 ppm to about 500 ppm.

Applicants speculate, without being thereby bound, that, unlike the prior art—in which an alkaline earth salt, such as soluble calcium, was available as free calcium ions (See, Letton, U.S. Pat. No. 4,318,818, column 6, lines 9–12)—the soluble alkaline earth salts of the present invention bind to the enzyme and appear to alter the enzyme to reduce its hydrophilicity, thus causing the enzyme to partition more readily to the oily phase represented by the less soluble of the nonionic surfactants used in the invention. It is this particular phenomenon which is believed responsible for the unexpectedly excellent stability of the enzyme in the highly aqueous systems of the invention, since, unlike the prior art, large quantities of solvents and other enzyme stabilizers are not needed herein. Moreover, the structured liquid in the invention does not apparently encapsulate the enzyme, but rather, closely associates with it, thus allowing the enzyme to perform well when a soiled fabric is contacted with the liquid prewash and thereafter diluted in the wash liquor.

2. Nonionic Surfactants

As stated beforehand, the nonionic surfactants used in the invention are essentially the only dispersing agents present in the invention, with any solvents such as propylene glycol or ethanol being present in trace amounts as manufacturing by-products of ingredients such as the surfactants, or as stabilizers for the enzymes. In fact, it has been found that large amounts of solvents, hydrotropes, and even inorganic salts, and other dispersants, can destabilize the structured liquid matrix of the invention and, for that reason, are generally avoided.

The nonionic surfactants are: a more hydrophilic, first nonionic surfactant having an HLB of greater than about 11 and a more hydrophobic, second nonionic surfactant having an HLB of less than about 11, with the further proviso that there is a difference, $\Delta$, of about at least 2, and most preferably, at least about 3, in the HLB values of the two surfactants.

The nonionic surfactants are selected from alkoxylated alcohols and alkoxylated alkylphenols. The alkoxylated alkylphenols are especially preferred. These surfactants appear to form a specific structured liquid in water. Here, the definition of a "structured liquid" is one where, unlike the interaction between surfactants and electrolytes in a liquid detergent containing builders or salts, the structuring is due to the separate interactions of the two surfactants with water and each other. Most preferred among the surfactant pairs is a combination of two ethoxylated nonylphenols, with one having an HLB at or below about 11 and the other, above, with a difference therebetween being at least about 2. The first surfactant can be chosen from, among others: Macol NP-9.5, an ethoxylated nonylphenol with about 11 moles EO and an HLB of 14.2, Macol NP-9.5, an ethoxylated nonylphenol with about 9.5 moles EO and an HLB of 13.0, both from Mazer Chemicals, Inc.; Triton N-101, an ethoxylated nonylphenol with 9–10 moles of ethylene oxide per mole of alcohol ("EO") having a hydrophile-lipophile balance ("HLB") of 13.4, Triton N-111, an ethoxylated nonylphenol with an HLB of 13.8, both from Rohm & Haas Co.; Igepal CO-730, with an HLB of 15.0, Igepal CO-720, with an HLB of 14.2, Igepal CO-710, with an HLB of 13.6, Igepal CO-660, with an HLB of 13.2, Igepal CO-620, with an HLB of 12.6, and Igepal CO-610 with an HLB of 12.2, all polyethoxylated nonylphenols from GAF Chemicals Corp.; Alkasurf NP-15, with an HLB of 15, Alkasurf NP-12, with an HLB of 13.9, Alkasurf NP-11, with an HLB of 13.8, Alkasurf NP-10, with an HLB of 13.5, Alkasurf NP-9, with an HLB of 13.4, and Alkasurf NP-8, with an HLB of 12.0, all polyethoxylated nonylphenols from Alkaril Chemicals; and Surfonic N-120, with an HLB of 14.1, Surfonic N-102, with an HLB of 13.5, Surfonic N-100, with an HLB of 13.3, Surfonic N-95, with an HLB of 12.9, and Surfonic N-85, with an HLB of 12.4, all polyethoxylated nonylphenols from Texaco Chemical Co. The second surfactant can be selected from Macol NP-6, an ethoxylated nonylphenol with 6 moles of EO, and an HLB of 10.8, Macol NP-4, an ethoxylated nonylphenol with 4 moles of EO, and an HLB of 8.8, both from Mazer Chemicals, Inc.; Triton N-57, an ethoxylated nonylphenol with an HLB of 10.0, Triton N-42, an ethoxylated nonylphenol with an HLB of 9.1, both from Rohm & Haas Co.; Igepal CO-530, with an HLB of 10.8, and Igepal CO-520, with and HLB of 10.0, both ethoxylated nonylphenols from GAF Chemicals Corp.; Alkasurf NP-6, with an HLB of 11.0, Alkasurf NP-5, with an HLB of 10.0, and Alkasurf NP-4, with an HLB of 9.0, all ethoxylated nonylphenols from Alkaril Chemicals; Surfonic N-60, with an HLB of 10.9, and Surfonic N-40, with an HLB of 8.9, both ethoxylated nonylphenols from Texaco Chemical Co. See, *McCutcheon's Emulsifiers and Detergents* (1987), especially page 282, incorporated herein by reference thereto. The amounts of the first and second surfactants are preferably in the range of about 0.1% to 9.99% and about 0.1% to 9.9%, respectively, and most preferably, about 3% to 6% and about 5% to 9%, respectively. The ratios of the first and second surfactants will be about 5:1 to 1:5, more preferably about 4:1 to 1:4, and most preferably about 3:1 to about 1:3.

The interaction between the surfactants is not believed to be a charged-based interaction, but may be due to unique structures occurring in the liquid phase. See, e.g., P. Ekwall, "Composition, Properties and Structures of Liquid Crystal and Phases in Systems of Amphiphilic Compounds"; and C. Miller et al., "Behavior of Dilute Lamellar Liquid-Crystal and Phases." *Colloids and Surfaces,* Vol. 19, pp. 197–223 (1986); and W. J. Benton et al., "Lyotropic Liquid Crystalline Phases and Dispersions in Dilute Anionic Surfactant-Alcohol-Brine Systems," *J. Physical Chemistry,* Vol. 87, pp. 4981–4991 (1983), which are incorporated herein by reference.

It is again speculated, without being thereby bound, that the first, more hydrophilic nonionic surfactant, is readily dispersed in water in the invention, thereby forming a first, continuous liquid phase, while the second, more hydrophobic nonionic surfactant forms a discontinuous, lamellar phase in the first, continuous phase. Light scattering studies appear to bear this out and the resulting liquid composition is an opalescent liquid (a complex, translucent liquid, which scatters visible light).

The alkoxylated alcohols include ethoxylated, propoxylated, and ethoxylated and propoxylated $C_{5-20}$ alcohols, with about 1–20 moles of ethylene oxide, or about 1–20 moles of propylene oxide, or 1–20 and 1–20 moles of ethylene oxide and propylene oxide, respectively, per mole of alcohol, with the selection of the first and second alkoxylated alcohol being determined according to HLB values, again. There are a wide variety of products from numerous manufacturers, such as the Neodol series from Texaco Chemical Co. See, also, *McCutcheon's Emulsifiers and Detergents,* 1987.

3. Water

The principal ingredient is water, which should be present at a level of at least about 80%, more preferably at least about 82%, and most preferably, at least about 85%. Deionized water is most preferred. It is again noted that water can deactivate enzymes because enzymes (with the exception of lipases) are generally somewhat hydrophilic in nature and water can mediate cross-digestion (especially in the case of proteases), leading to significant loss of enzyme activity. However, the unique and surprising liquid structure of the invention is responsible for the suspension and protection of the enzymes within the aqueous medium.

4. Acids/Buffers

Acids, such as inorganic mineral acids (e.g., hydrochloric acid, sulfuric acid, sulfurous acid, sulfamic acid, phosphoric acid) and organic acids (e.g., short chain carboxylic acids, formic, acetic, propionic, succinic acids) may be added in low amounts (preferably, about 0.1–10%) to adjust to an acidic pH. Buffers, such as citric acid, can be used to maintain such acidic pH. It has been surprisingly discovered that the stability of the inventive enzyme prewash composition is optimal over acidic ranges, namely from about above pH 4 to just below about 8, most preferably about pH 5 to 7. This result was very surprising since some important enzymes, namely alkaline proteases, are sought be stabilized by others at an alkaline pH, where their performance is optimal. Applicants have observed that the enzymes can be safely stored without loss of activity at low pH's. Thus, when the enzymes present in the inventive high water enzyme prewash composition are released when a fabric bearing an amount of the composition is placed in wash water, the enzymes' activity is retained so that their performance on stains is maximized.

5. Miscellaneous Adjuncts

Small amounts of adjuncts can be added for improving cleaning performance or aesthetic qualities of the prewash invention. Aesthetic adjuncts include fragrances, such as those available from Givaudan, IFF, Quest and others, and dyes and pigments which can be solubilized or suspended in the formulation. The fragrance oils may require a dispersant, although amounts thereof should be quite limited. The amounts of these cleaning and aesthetic adjuncts should be in the range of 0–2%, more preferably 0–1%. Additionally, because the surfactants in liquid systems are sometimes subject to attack from microorganisms, it is advantageous to add a mildewstat or bacteristat. It has been surprisingly discovered that mildewstats/bacteristats which are not formaldehyde-exuding are preferred herein. Apparently, formaldehyde acts to deactivate the enzyme in the prewash formulation. Exemplary non-formaldehyde-exuding mildewstats (including non-isothiazolone compounds) include Kathon GC, a 5-chloro-2-methyl-4-isothiazolin-3-one, Kathon ICP, a 2-methyl-4-isothiazolin-3-one, and a blend thereof, and Kathon 886, a 5-chloro-2-methyl-4-isothiazolin-3-one, all available from Rohm and Haas Company; Bronopol, a 2-bromo-2-nitropropane 1,3-diol, from Boots Company Ltd.; Proxel CRL, a propyl-p-hydroxybenzoate, from ICI PLC; Nipasol M, an o-phenyl-phenol, $Na^+$ salt, from Nipa Laboratories Ltd.; Dowicide A, a 1,2-benzoisothiazolin-3-one, from Dow Chemical Co.; and Irgasan DP 200, a 2,4,4'-trichloro-2-hydroxydiphenylether, from Ciba-Geigy A.G. See also, Lewis et al., U.S. Pat. Nos. 4,252,694 and 4,105,431, incorporated herein by reference.

In the following Experimental section, the surprising performance benefits of the various aspects of the inventive prewash are demonstrated.

Experimental

The preferred base formulation for the inventive high water enzyme prewash composition is set forth in Example I, while a comparison, non-enzyme prewash formulation is set forth in Example II.

TABLE I

| Prewash Ingredient | Example I (wt. %) | Example II (wt. %) |
|---|---|---|
| 1st Surfactant[1] | 3–6 | 5–6 |
| 2nd Surfactant[2] | 5–9 | 7–9 |
| NaCl | | 4.50 |
| Formaldehyde[3] | — | 0.093 |
| Isothiazolone solution[3] | 0.10 | — |
| Fragrance | 0.10 | 0.10 |
| Blue Dye Solution | 0.25 | 0.25 |
| Enzyme Solution[4] | 0.25 | — |
| $Ca^{++}$ ion[5] | 10–500 ppm | — |
| Deionized Water | q.s. | q.s. |

[1]Nonylphenol ethoxylate, HLB >11
[2]Nonylphenol ethoxylate, HLB ≦11
[3]Mildewstat/Bacteristat
[4]Alkaline protease
[5]Enzyme stabilizer

EXAMPLE III

The base formulation of Example I was stored for 15 weeks at room temperature (21.1° C.), for the purposes of determining long term storage stability. As can be seen from the graph in FIG. 1 hereto, wherein % enzyme remaining is plotted as the y axis and time in weeks in plotted as the x axis, surprisingly substantial activity was retained by the enzyme over an extended period of time.

EXAMPLE IV

Figure 2:
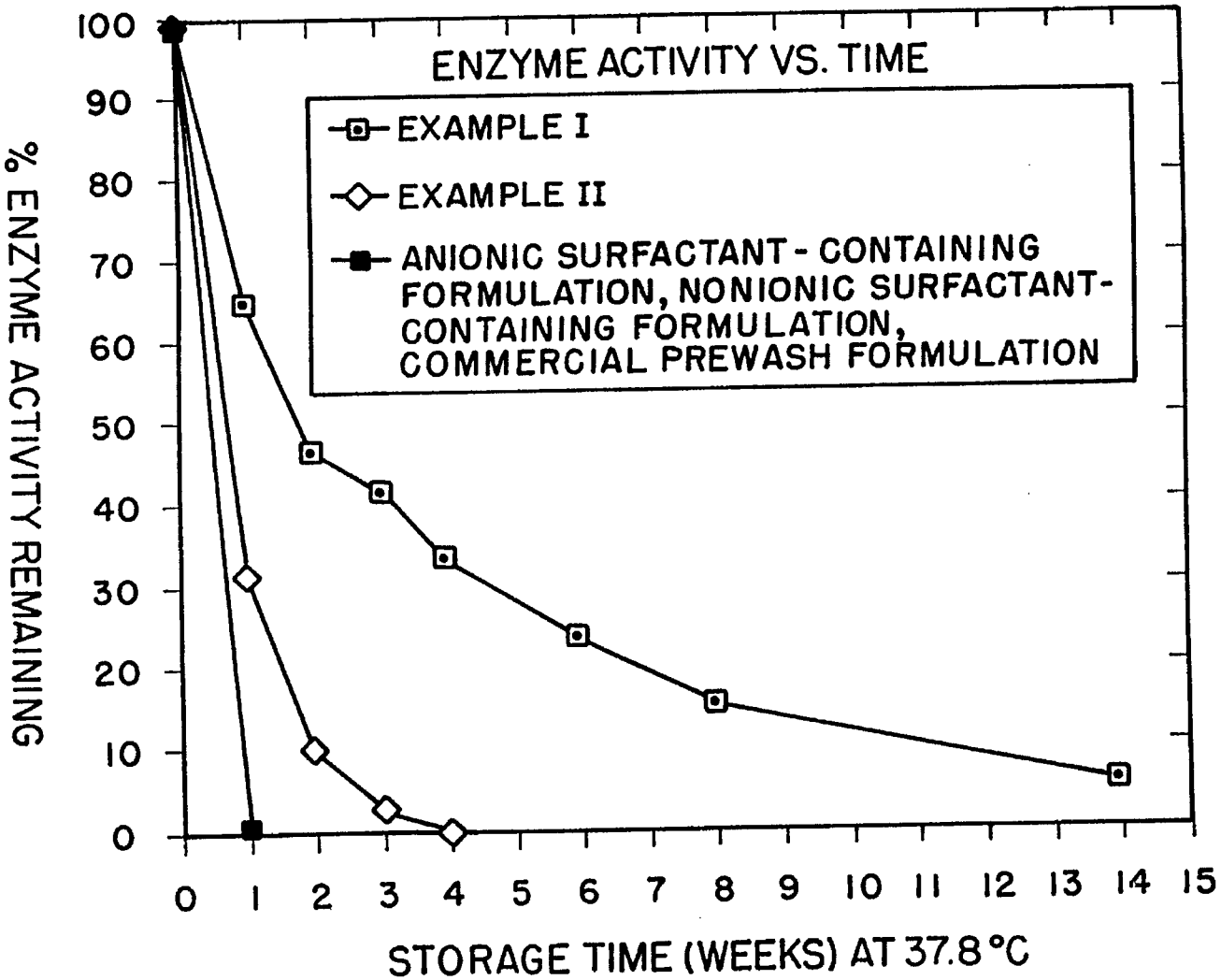
FIG. 2 is a graph plotting % retained enzyme activity versus time in weeks for the inventive high water liquid enzyme prewash composition at high temperatures, and, in addition, in comparison with % retained enzyme activity versus time in weeks for a number of comparative formulations.

In this example, the invention as exemplified in Example I was compared against the non-enzyme-containing Example II, and formulations containing either: a sole nonionic surfactant ($C_{12-14}$ alcohol ethoxylate, 7 moles ethylene oxide), an anionic surfactant ($C_{12}$ alkyl ether sulfate, $^{18}$ 2–3 moles ethylene oxide), and a commercial liquid prewash, in all of which the same enzyme, an alkaline protease (stabilized with $Ca^{++}$ in the levels of Example I), was added. The samples were stored at 37.8° C., in order to simulate advanced aging of the samples. The results are graphically depicted in FIG. 2, in which % enzyme remaining is plotted as the y axis and time in weeks in plotted as the x axis. Surprisingly, the inventive formulation significantly outperformed all of the comparative examples over an extended period of time (the latter three examples were plotted along the same line, since their results were essentially similar).

EXAMPLE V

Figure 3:
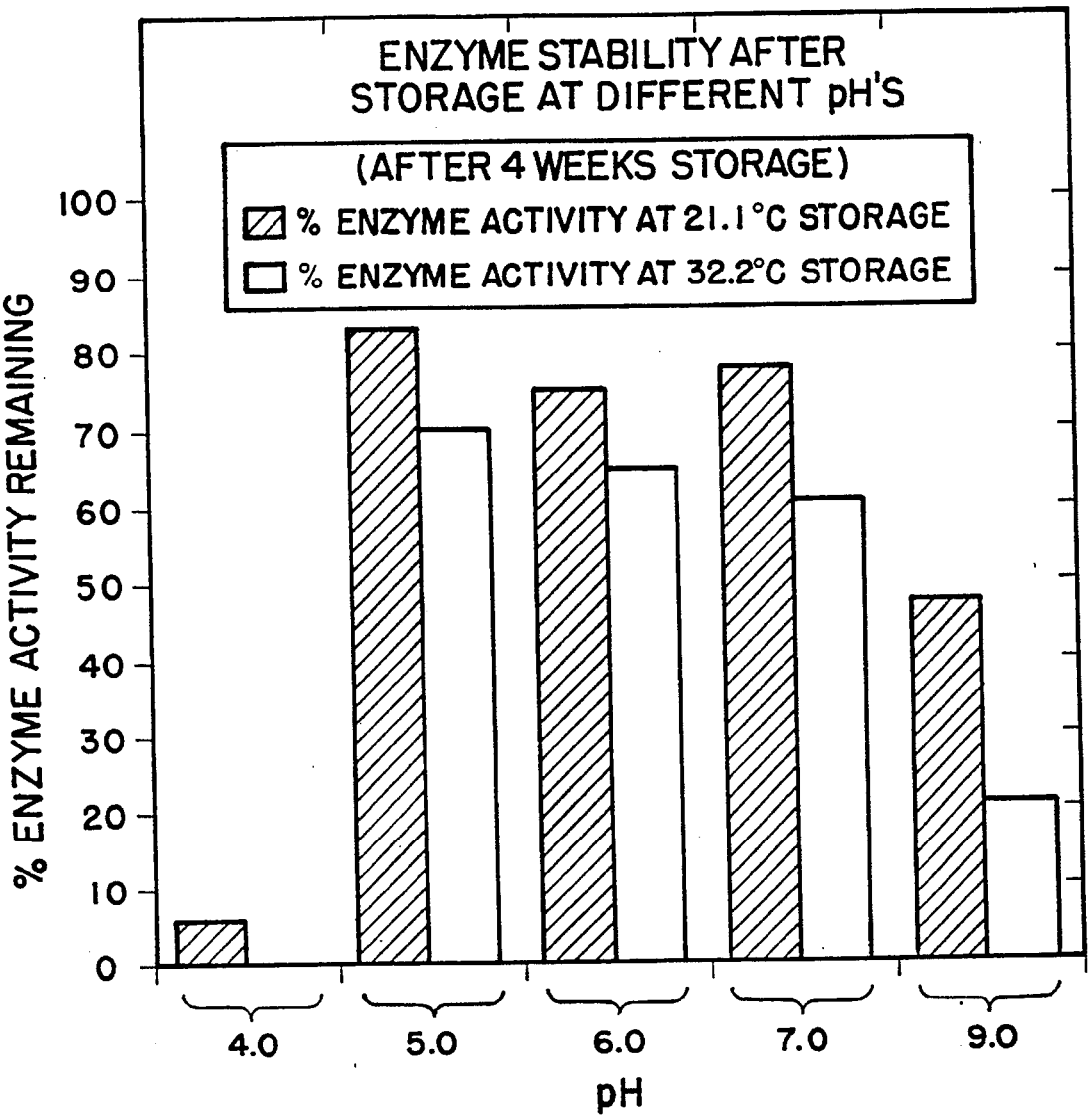
FIG. 3 is a bar graph comparing % retained enzyme activity at various pH's for the inventive high water liquid enzyme prewash composition.

In Example V, performance of the inventive formulation as set forth in Example I was compared at different pH's. It was surprisingly discovered that buffering the formulation to acidic pH's resulted in unexpected stabilization of enzyme activity. In summary, results at about pH 5–7 were dramatically superior to other pH's, leading to preference herein for formulating at those acidic p's. This is in contrast to most of the prior art, in which alkaline pH appears to be preferred, since many formulations utilize alkaline proteases, whose performance is optimal at alkaline pH's. The results are depicted in FIG. 3. The stability of the enzyme was assayed as % remaining enzyme activity after 4 weeks storage at 21.1° C. and 32.2° C., with the 21.1° C. results represented by the diagonally-striped bar, and the 32.2° C. results represented by the shaded bar.

EXAMPLE VI

In this example, performance studies were undertaken with the inventive high water prewash formulation having been stored for nine months at 21.1° C., 26.6° C., 32.2° C. and 37.8° C. respectively. The % soil removal was measured for cotton swatches stained with grass stain (a typical, enzyme-sensitive stain). The swatches were each treated with high water prewash formulation as in Example I, the prewash being allowed to reside for 1–2 minutes, after which each was washed in washwater batches according to ASTM method, using prescribed amounts of Tide® detergent (Procter & Gamble Company). One of the samples was a blank, meaning no enzyme was present in the prewash formulation used to treat that particular set of swatches. The results were as follows:

TABLE II

| 9 Mo. Storage Temp. | Grass Stain % Removal |
|---|---|
| No Enzyme | 78.1 |
| Enzyme @ 21.1° C. | 94.9 |
| Enzyme @ 26.6° C. | 94.8 |
| Enzyme @ 32.2° C. | 93.0 |
| Enzyme @ 37.8° C. | 76.7 |
| LSD | 3.55 |
| HSD | 5.14 |

The invention is further defined without limitation of scope or of equivalents by the claims which follow hereto.

We claim:

1. A high water liquid enzyme prewash composition without hydrotropes, organic solvents and surfactants, other than nonionic surfactants, said composition consisting essentially of:

a) about 0.0001–10% of a hydrolase enzyme stabilized with about 1–10,000 ppm of a soluble alkaline earth salt;

b) about 0.1–9.99% of a more hydrophilic, first nonionic surfactant having an HLB of greater than about 11;

c) about 0.1–9.99% of a more hydrophobic, second nonionic surfactant having an HLB of less than or equal to about 11;

d) about 80–99% water;

wherein the difference in HLB between said first and second nonionic surfactants is at least 2, and said nonionic surfactants interact with said water to form an opalescent, structured liquid, said structured liquid both suspending said hydrolase and protecting said hydrolase against deactivation with said water wherein first and second nonionic surfactants are selected from the groups consisting of $C_5$–$C_{20}$ alcohols with 1–20 mole of ethylene oxide, propylene oxide or mixtures of ethylene oxide and propylene oxide and alkoxylated alkyl phenols.

2. The liquid enzyme prewash composition of claim 1 wherein said hydrolase is a protease, an amylase, or a mixture thereof.

3. The liquid enzyme prewash composition of claim 2 wherein said hydrolase is an alkaline protease stabilized with a soluble alkaline earth salt.

4. The liquid enzyme prewash composition of claim 3 wherein said soluble alkaline earth salt interacts with said alkaline protease to maintain said protease in suspension in said structured liquid.

5. The liquid enzyme prewash composition of claim 4 wherein said soluble alkaline earth salt is selected from soluble magnesium and calcium salts.

6. The liquid enzyme prewash composition of claim 1 wherein said first and second nonionic surfactants are two different alkoxylated alkylphenols.

7. The liquid enzyme prewash composition of claim 6 wherein said first nonionic surfactant forms a first, continuous phase with said water and said second nonionic surfactant forms a dispersed, lamellar phase in said first phase.

8. The liquid enzyme prewash composition of claim 1 further comprising a buffer to maintain a pH of about above 4 to just blow about 8.

9. The liquid enzyme prewash composition of claim 6 wherein said first nonionic surfactant is selected from ethoxylated nonylphenols with an HLB of about 12 or greater and said second nonionic surfactant is selected from ethoxylated nonylphenols with an HLB of 10 or less.

10. The liquid enzyme prewash composition of claim 6 wherein said first nonionic surfactant is an ethoxylated nonylphenol with 9–10 moles of ethylene oxide per mole of alcohol and an HLB of 13.4 and said second nonionic surfactant is an ethoxylated nonylphenol with an HLB of 10.

11. The liquid enzyme prewash composition of claim 6 wherein the amounts of said first and second nonionic surfactants are from about 3–6% and about 5–9%, respectively.

12. The liquid enzyme prewash composition of claim 6 wherein the ratios of said first and second nonionic surfactants is about 5:1 to 1:5.

13. The liquid enzyme prewash composition of claim 11 wherein said acid is either an inorganic acid or an organic acid.

14. The liquid enzyme prewash composition of claim 11 wherein said pH is maintained by means of a buffer.

15. The liquid enzyme prewash composition of claim 1 further comprising an aesthetic adjunct selected from the group consisting of fragrances, dyes, pigments, mildewstats and bacteristats.

* * * * *